US007420327B2

(12) United States Patent
Fujitani

(10) Patent No.: US 7,420,327 B2
(45) Date of Patent: Sep. 2, 2008

(54) PLASMA DISPLAY PANEL

(75) Inventor: Morio Fujitani, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 582 days.

(21) Appl. No.: 10/530,661

(22) PCT Filed: Sep. 3, 2004

(86) PCT No.: PCT/JP2004/013181

§ 371 (c)(1),
(2), (4) Date: Apr. 6, 2005

(87) PCT Pub. No.: WO2005/024886

PCT Pub. Date: Mar. 17, 2005

(65) Prior Publication Data

US 2005/0285523 A1 Dec. 29, 2005

(30) Foreign Application Priority Data

Sep. 3, 2003 (JP) ..... 2003-311516

(51) Int. Cl.
*H01J 17/49* (2006.01)

(52) U.S. Cl. ..... 313/582; 313/585

(58) Field of Classification Search ..... 313/581–587, 313/232, 238, 292

See application file for complete search history.

(56) References Cited

U.S. PATENT DOCUMENTS

| | | | | |
|---|---|---|---|---|
| 6,008,582 | A * | 12/1999 | Asano et al. | 313/582 |
| 6,674,238 | B2 * | 1/2004 | Otani et al. | 313/587 |
| 7,205,963 | B2 * | 4/2007 | Amatsuchi | 345/67 |
| 2001/0030510 | A1 * | 10/2001 | Amemiya et al. | 313/582 |
| 2003/0222580 | A1 * | 12/2003 | Amatsuchi | 313/586 |
| 2005/0179383 | A1 * | 8/2005 | Kimura et al. | 313/582 |

FOREIGN PATENT DOCUMENTS

| | | | |
|---|---|---|---|
| JP | 10-326570 | A | 12/1998 |
| JP | 2001-110325 | A | 4/2001 |
| JP | 2001-222958 | A | 8/2001 |
| JP | 2003-092064 | A | 3/2003 |
| WO | WO 03/023808 | A1 | 3/2003 |

* cited by examiner

*Primary Examiner*—Ashok Patel
(74) *Attorney, Agent, or Firm*—RatnerPrestia

(57) ABSTRACT

A plasma display panel includes a front panel and a rear panel disposed opposing each other. The front panel includes a display electrode composed of a scan electrode and a sustain electrode extending in a row direction. A rear panel includes address electrode extending in a column direction and intersecting the display electrode. A lattice form of barrier ribs of row direction barrier ribs and column direction barrier ribs, which have the same height, forming a plurality of individually divided discharge cells is provided in a part in which the display electrode and the address electrode intersect each other. The row direction barrier ribs of the barrier ribs are provided with communication portions communicating discharge cells in non-parallel to the column direction.

20 Claims, 15 Drawing Sheets

PLASMA DISPLAY PANEL

This application is a U.S. national phase application of PCT international application PCT/JP2004/013181.

TECHNICAL FIELD

The present invention relates to a plasma display panel known as a display device.

BACKGROUND ART

Recently, expectation for a large-screen wall-mount television set as a bi-directional information terminal has increased. Display devices therefor include many devices such as a liquid-crystal display panel, a field emission display, an electroluminescence display, and the like. Among these display devices, much attention has focused on a plasma display panel (hereinafter, referred to as "PDP") as a thin display device excellent in visibility because it is a self light-emitting type display device capable of displaying beautiful images and realizing a large screen easily, etc. Development of higher definition and larger screen PDPs is under way.

PDPs are roughly classified into AC type and DC type in terms of driving, and also classified into surface discharge type and opposing discharge type. For higher definition, larger screen and ease in manufacturing, at present, PDP of AC type and surface discharge type is becoming prevalent.

FIG. 22 shows an example of a panel structure of a conventional PDP. The PDP includes front panel 101 and rear panel 102 disposed opposing each other. Note here that in FIG. 22, for easy understanding of the structure, front panel 101 and rear panel 102 are drawn separately.

Front panel 101 includes plural pairs of stripe-shaped display electrodes 106 composed of scan electrode 104 and sustain electrode 105 on transparent front substrate 103 such as a glass substrate made of a sodium borosilicate glass made by the floating method. Dielectric layer 107 is formed so as to cover a group of display electrodes 106. Protective film 108 made of MgO is formed on dielectric layer 107. Note here that scan electrode 104 and sustain electrode 105 are respectively composed of transparent electrodes 104*a* and 105*a* and bus electrodes 104*b* and 105*b* which are made of Cr/Cu/Cr, Ag, or the like and electrically connected to transparent electrodes 104*a* and 105*a*.

On the other hand, rear panel 102 includes address electrodes 110 in the direction intersecting display electrodes 106 on rear substrate 109 disposed opposing front substrate 103. Dielectric layer 111 is formed so as to cover address electrode 110. On dielectric layer 111 between address electrodes 110, a plurality of stripe-shaped barrier ribs 112 are formed in parallel to address electrodes 110. On the side faces of a part between barrier ribs 112 and on the surface of dielectrics layer 111, phosphor layers 113 are formed. For color displaying, phosphor layers 113 are usually arranged in the order of red, green, and blue.

Front panel 101 and rear panel 102 are disposed opposing each other with barrier ribs 112 interposed therebetween and sealed together at the peripheries with a sealing material such that display electrode 106 and address electrode 110 intersect each other and small discharge space is formed inside. Discharge gas obtained by mixing Ne (neon), Xe (xenon), and the like, is filled in the discharge space at a pressure of about 66500 Pa (500 Torr). Thus, the PDP is formed.

The discharge space of the PDP is divided into a plurality of partitions by barrier ribs 112. Display electrodes 106 are provided orthogonal to address electrode 110 so that a plurality of discharge cells, which are unit light-emitting regions, are formed between barrier ribs 112.

In this PDP, images are displayed by generating electric discharge by a periodic voltage applied to address electrode 110 and display electrode 106, and irradiating phosphor layer 113 with ultraviolet light generated by the electric discharge, so that the ultraviolet light is converted into visible light by the phosphor layer 113.

FIG. 23 is a plan view showing a schematic configuration of an image display part of a PDP. As shown in FIG. 23, scan electrode 104 and sustain electrode 105 constituting display electrode 106 are arranged extending in the column direction with discharge gap 114 interposed therebetween in each line of a matrix display. Therefore, a region, which is divided by barrier ribs 112 and in which display electrode 106 and address electrode 110 intersect each other, becomes discharge cell 115 that is a unit light-emitting region. Furthermore, non-light emitting region 116 may be provided with a black stripe (not shown) for the purpose of improving contrast. The configuration of a conventional PDP is disclosed in a non-patent document "Plasma Display Panel no subete (All about Plasma Display Panel)" (Heiju Uchiike and Shigeo Mikoshiba, Kogyo Chosakai Publishing Inc., May 1, 1997, p 79-p 80).

PDP is required to have higher brightness, higher efficiency, lower power consumption, and lower cost. A method for achieving high brightness includes, for example, in a configuration shown in FIG. 23, a method of broadening a discharging region by narrowing non light-emitting region 116 between neighboring discharge cells 115 so as to broaden the interval between the electrodes at the side of discharge gap 114. However, in this case, there may be a problem that discharge error between neighboring discharge cells 115 is increased. In order to solve such a problem, it is thought that discharge error is suppressed by forming barrier ribs 112 in a lattice, which, however, may make it difficult to satisfactorily release impurity gas from an inner space of the PDP and to fill discharge gas into the inner space of the PDP.

In view of the above-mentioned problems, the present invention was made and the object thereof is to realize a PDP capable of suppressing discharge error, satisfactorily releasing impurity gas from an inner space of the PDP and filling discharge gas into the inner space of the PDP, thus improving brightness and image quality.

SUMMARY OF THE INVENTION

In order to achieve the above-mentioned object, a PDP of the present invention includes a front panel and a rear panel disposed opposing each other. The front panel includes a display electrode composed of a scan electrode and a sustain electrode extending in a row direction. The rear panel includes an address electrode extending in a column direction and intersecting the display electrode. In the PDP, a plurality of individually divided discharge cells are formed in a part in which the display electrode and address electrode intersect each other, and discharge cells neighboring in the column direction communicate to each other by communication portions communicating in non-parallel to the column direction.

According to such a configuration, it becomes possible to realize a PDP capable of suppressing discharge error, releasing impurity gas from an inner space of the PDP and filling discharge gas into the inner space of the PDP, satisfactorily, this improving brightness and image quality.

DETAILED DESCRIPTION OF PREFERRED EMBODIMENT

Hereinafter, a PDP according to exemplary embodiments of the present invention is described with reference to drawings.

First Exemplary Embodiment

Figure 1:
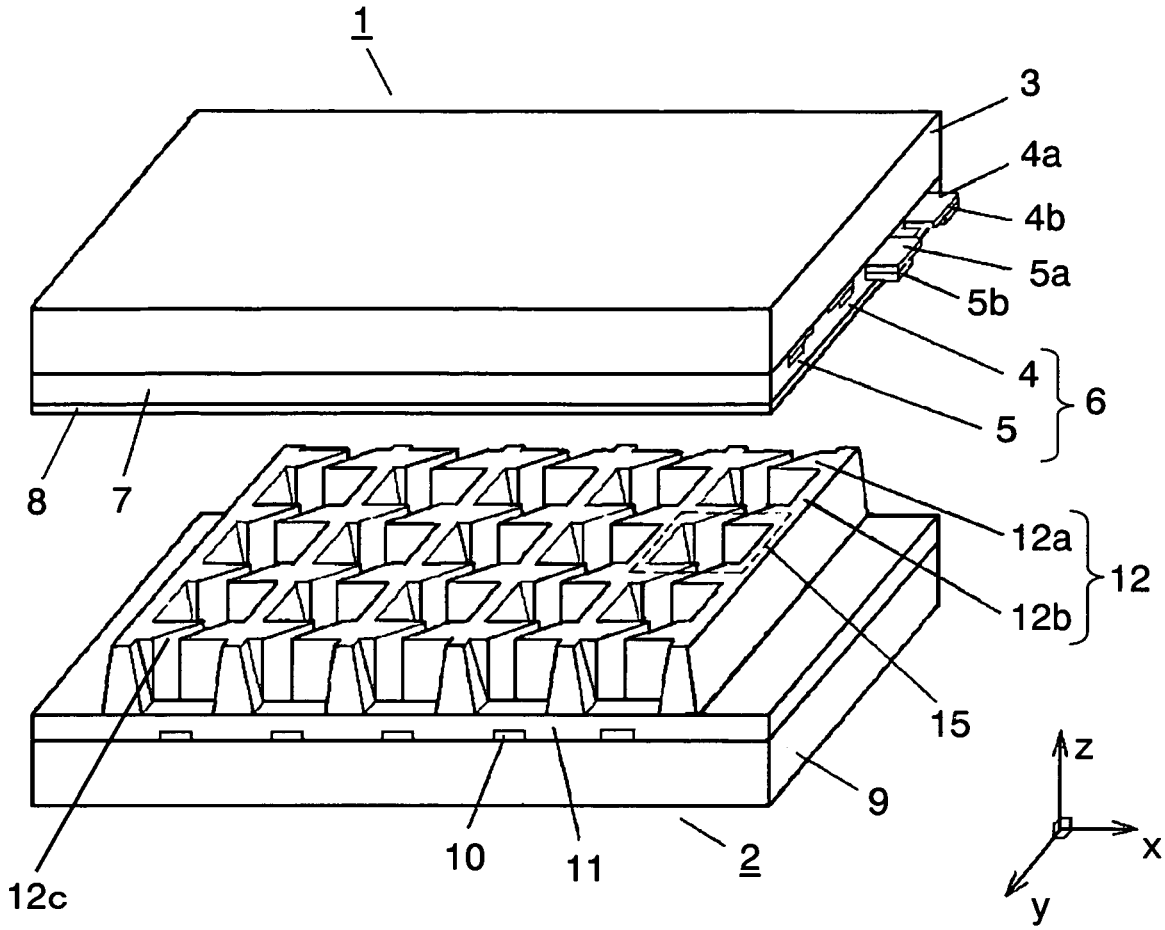
FIG. 1 is a perspective view showing a schematic configuration of a PDP according to a first exemplary embodiment of the present invention.

FIG. 1 is a perspective view showing a schematic configuration of a PDP according to a first exemplary embodiment of the present invention.

As shown in FIG. 1, a PDP according to the first exemplary embodiment includes front panel 1 and rear panel 2. Note here that in FIG. 1, for easy understanding of the structure, front panel 1 and rear panel 2 are drawn separately.

Front panel 1 includes plural pairs of stripe-shaped display electrodes 6 composed of scan electrode 4 and sustain electrode 5, extending in the row direction (in the direction of x in FIG. 1), on transparent front substrate 3 such as a glass substrate made of sodium borosilicate glass made by the floating method. Dielectric layer 7 is formed so as to cover a group of display electrodes 6. Protective film 8 made of MgO is formed on dielectric layer 7. Note here that scan electrode 4 and sustain electrode 5 are respectively composed of transparent electrodes 4*a* and 5*a* and bus electrodes 4*b* and 5*b* which are made of Cr/Cu/Cr, Ag, or the like, and electrically connected to transparent electrodes 4*a* and 5*a*.

On the other hand, rear panel 2 includes address electrodes 10, extending in the column direction (in the direction of y in FIG. 1) and intersecting display electrodes 6, on rear substrate 9 disposed opposing front substrate 3. Dielectric layer 11 is formed so as to cover address electrode 10, and barrier ribs 12 are formed on dielectric layer 11. Barrier ribs 12 are formed in a lattice of row direction barrier ribs 12*a* and column direction barrier ribs 12*b*, which are equal in height. Furthermore, row direction barrier ribs 12*a* of barrier ribs 12 are provided with communication portions 12*c* in non-parallel to the column direction.

Then, on the side faces of a part between barrier ribs 12 and on the surface of dielectric layer 11, phosphor layers (not shown) are formed. For color displaying, the phosphor layers are usually arranged in the order of red, green and blue.

Front panel 1 and rear panel 2 are disposed opposing each other and sealed together at the peripheries with a sealing material with barrier ribs 12 interposed therebetween such that display electrode 6 and address electrode 10 intersect each other and small discharge space is formed inside. Discharge gas, for example, obtained by mixing xenon (Xe) and at least one of neon (Ne) and helium (He) is filled in the discharge space at a pressure of about 66500 Pa (500 Torr). Thus, the PDP is formed. Herein, from the viewpoint of efficiency, it is preferable that the partial pressure of Xe is 5% to 50%.

The discharge space of the PDP is divided into a plurality of partitions by barrier ribs 12. Display electrode 6 and address electrode 10 are disposed intersecting each other so that each of the divided discharge space becomes discharge cell 15, that is, a unit light emitting region.

In this PDP, images are displayed by generating electric discharge by a periodic voltage applied to address electrode 10 and display electrode 6, and irradiating a phosphor layer with ultraviolet light generated by the electric discharge, so that the ultraviolet light is converted into visible light by the phosphor layer.

Figure 2:
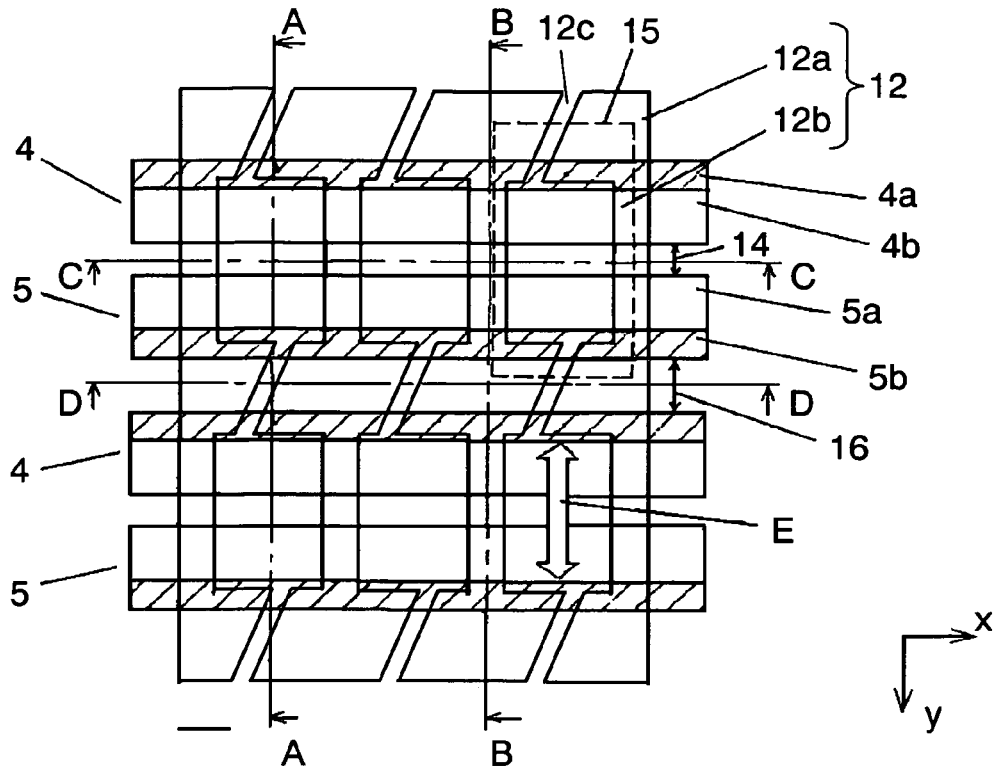
FIG. 2 is a plan view showing a schematic configuration of an image display part seen from the side of a front panel of the PDP.
Figure 3:
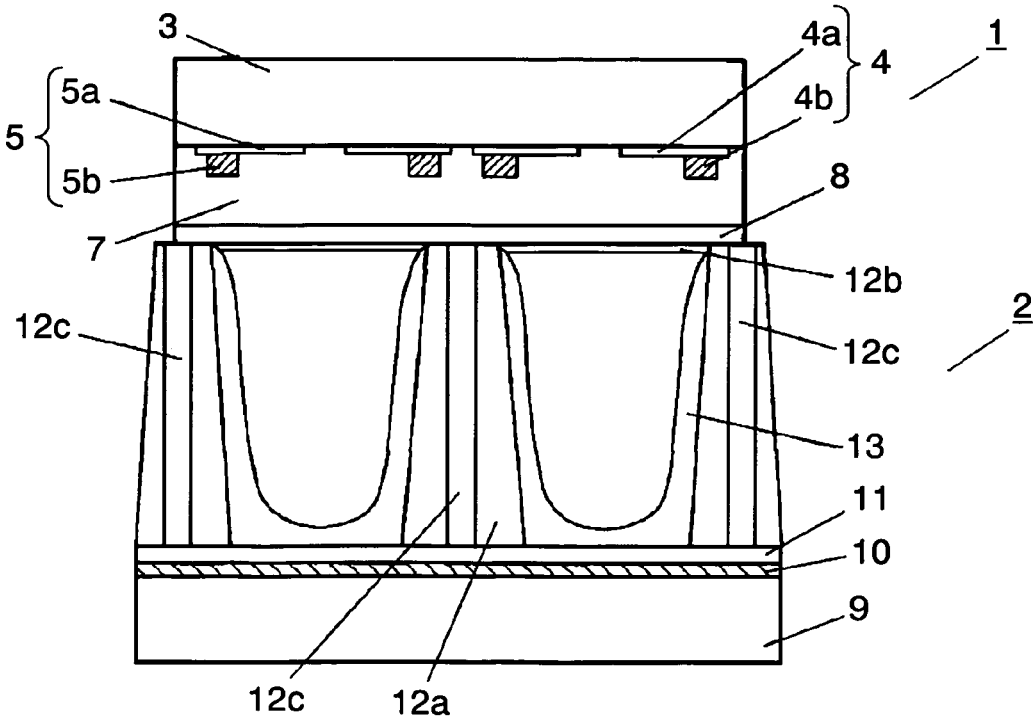
FIG. 3 is a sectional view of a part along line A-A of FIG. 2.
Figure 4:
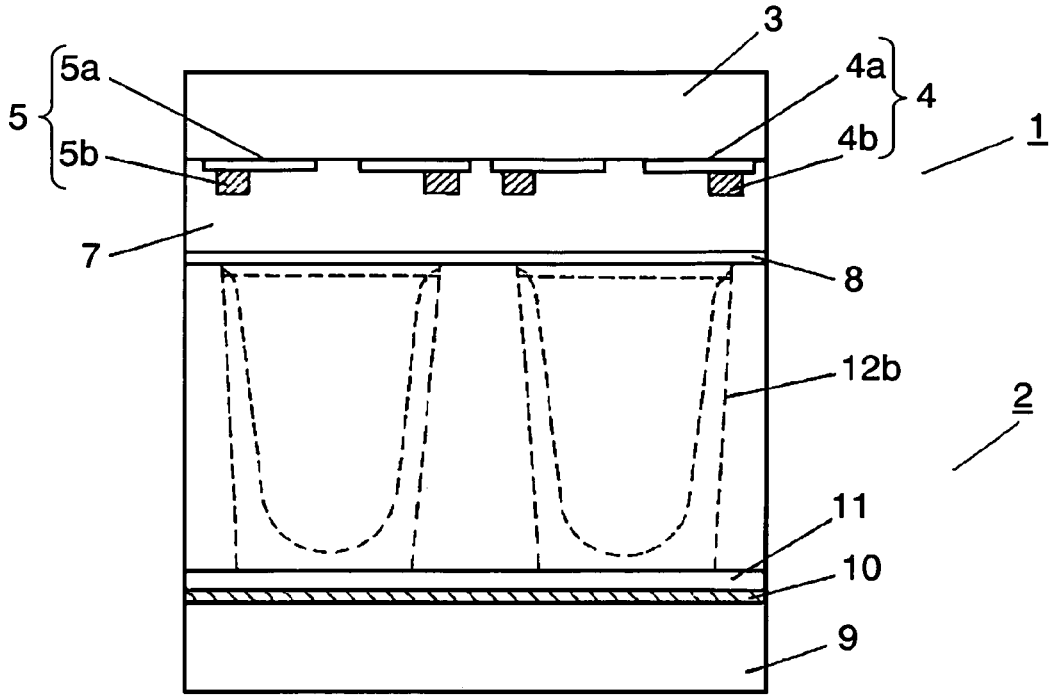
FIG. 4 is a sectional view of a part along line B-B of FIG. 2.
Figure 5:
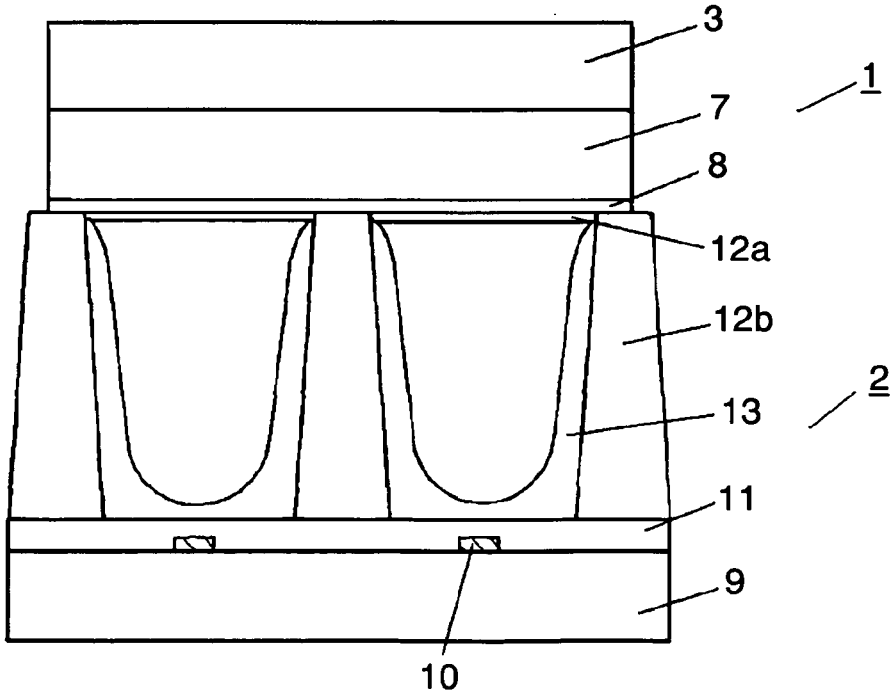
FIG. 5 is a sectional view of a part along line C-C of FIG. 2.
Figure 6:
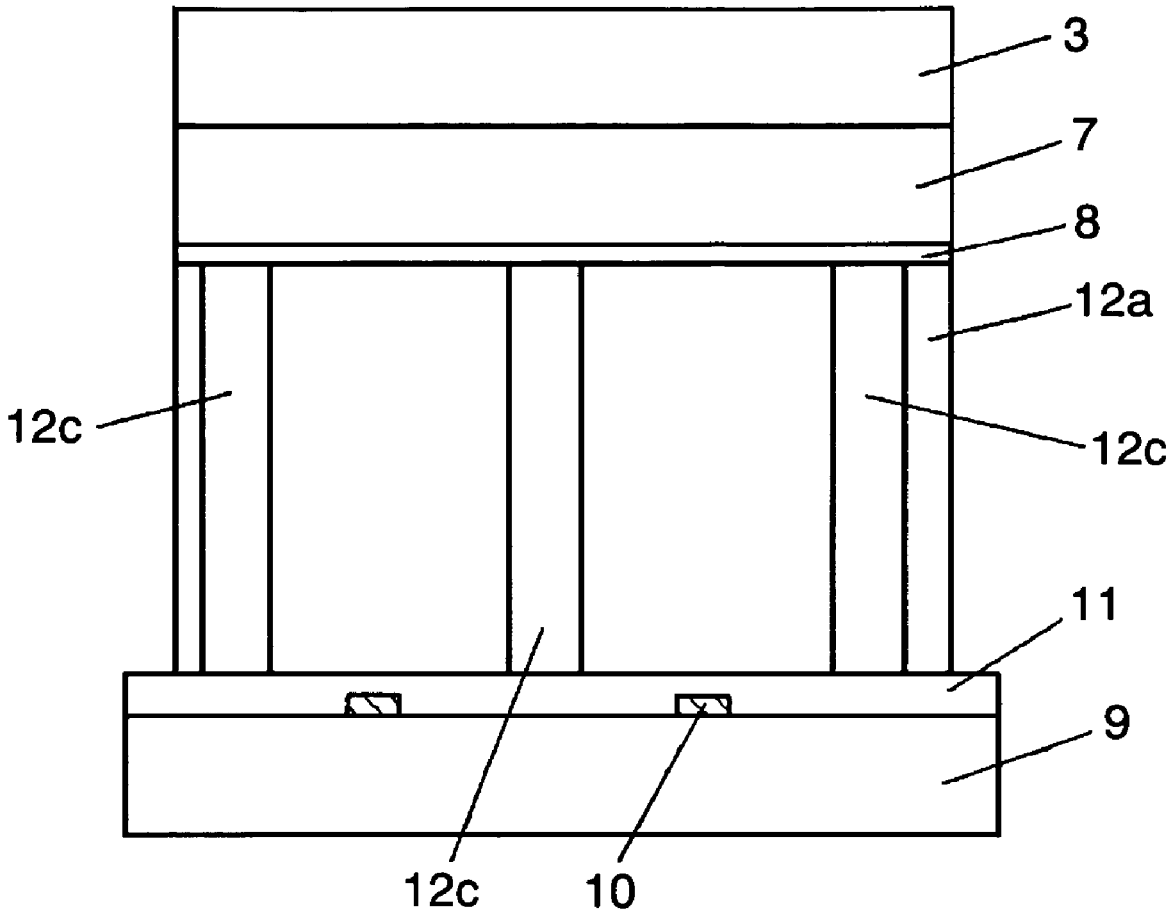
FIG. 6 is a sectional view of a part along line D-D of FIG. 2.

FIG. 2 is a plan view showing a schematic configuration of an image display part seen from the side of a front panel of the PDP according to the first exemplary embodiment of the present invention. Furthermore, sectional views of parts along lines A-A, B-B, C-C and D-D of FIG. 2 are shown in FIGS. 3, 4, 5 and 6, respectively. Furthermore, in these figures, also phosphor layer 13 is additionally shown.

As shown in FIGS. 2 to 6, scan electrode 4 and sustain electrode 5 are arranged alternately in the column direction such that they are neighboring each other with discharge gap 14 interposed therebetween in each line of a matrix display. Herein, a region surrounded by row direction barrier ribs 12*a* and column direction barrier ribs 12*b* becomes discharge cell 15 that is a unit light-emitting region. Furthermore, non-light emitting region 16 may be provided with a black stripe (not shown) for the purpose of improving contrast.

In the PDP according to the first exemplary embodiment of the present invention mentioned above, barrier ribs 12 are arranged in a lattice in which the height of row direction barrier rib 12*b* and the height of column direction barrier rib 12*b* are equal to each other, and form a plurality of individually divided discharge cells 15 in a part in which display electrode 6 and address electrode 10 intersect each other. Further, row direction barrier ribs 12*a* are provided with communication portions 12*c* communicating between neighboring discharge cells 15 in non-parallel to the column direction.

Figure 7A:
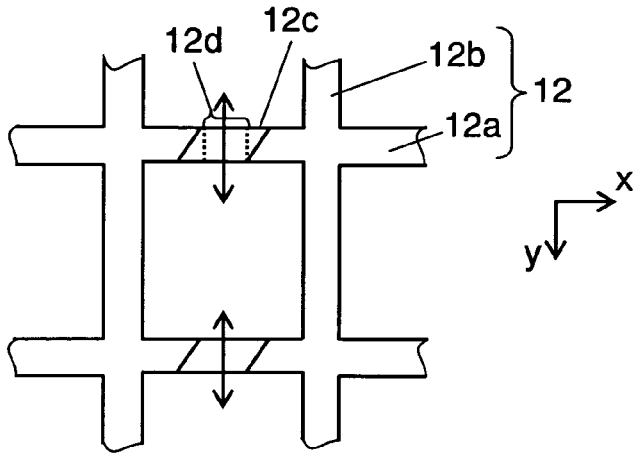
FIG. 7 is a plan view showing a detail of a barrier rib of the PDP.
Figure 7B:
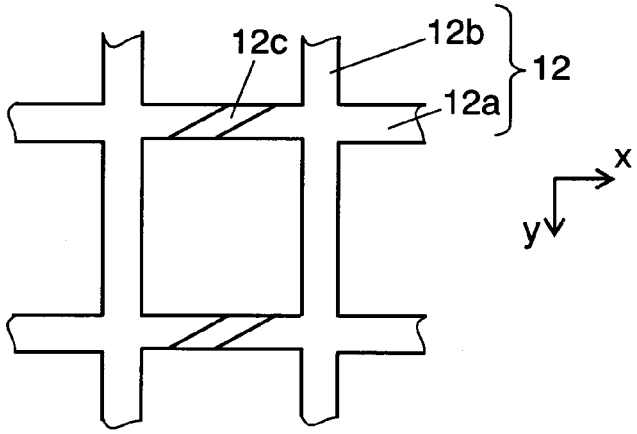

Herein, "communicating in non-parallel to the column direction" means that communication portion 12*c* does not communicate between neighboring discharge cells 15 in parallel to the column direction. FIG. 7 is a plan view showing a detail of barrier rib 12. As shown in FIG. 7A, even when communication portion 12*c* is provided in non-parallel to the column direction (in the direction of y), in a case where communication portion 12*c* has region 12*d* communicating in parallel, it is not included in the category of the present invention. On the other hand, as shown in FIG. 7B, communication portion 12*c* in a state in which a region communicating in parallel does not exists is communication portion 12*c* "communicating in non-parallel to the column direction" according to the present invention.

In the PDP according to this exemplary embodiment, by providing such barrier ribs 12, discharge error between neighboring discharge cells 15 can be suppressed, and also impurity gas can be released from the inner part of the PDP and discharge gas can be filled into the inner part of the PDP, satisfactorily.

That is to say, in this exemplary embodiment, barrier ribs 12 are arranged in a lattice, in which the height of row direction barrier rib 12*b* and the height of column direction barrier rib 12*b* are equal to each other, so as to surround the periphery of discharge cell 15. However, since row direction barrier ribs 12*a* of barrier ribs 12 are provided with communication portions 12*c*, impurity gas can be released from individual discharge cells 15 and discharge gas can be filled into individual discharge cells 15, satisfactorily.

Furthermore, the reason why discharge error occurs is thought to because charged particles due to discharge reach neighboring discharge cells 15 so as to affect them. The charged particles have vectors of movement along potential distribution generated by a voltage applied between scan electrode 4 and sustain electrode 5. That is to say, as shown by an arrow E of FIG. 2, charged particles having vectors in parallel to the column direction are main charged particles. Therefore, even when barrier ribs 12*a* are provided with communication portions 12*c*, since the communication portions 12*c* are provided in non-parallel to the column direction, the probability of charged particles passing through communication portions 12*c* and reaching neighboring discharge cells 15 reduces, thus enabling a problem of discharge error to be suppressed.

Note here that in the above description, an example in which one communication portion 12*c* is provided in each row direction barrier rib 12*a*. However, a plurality of communication portions 12*c* may be provided.

Figure 8:
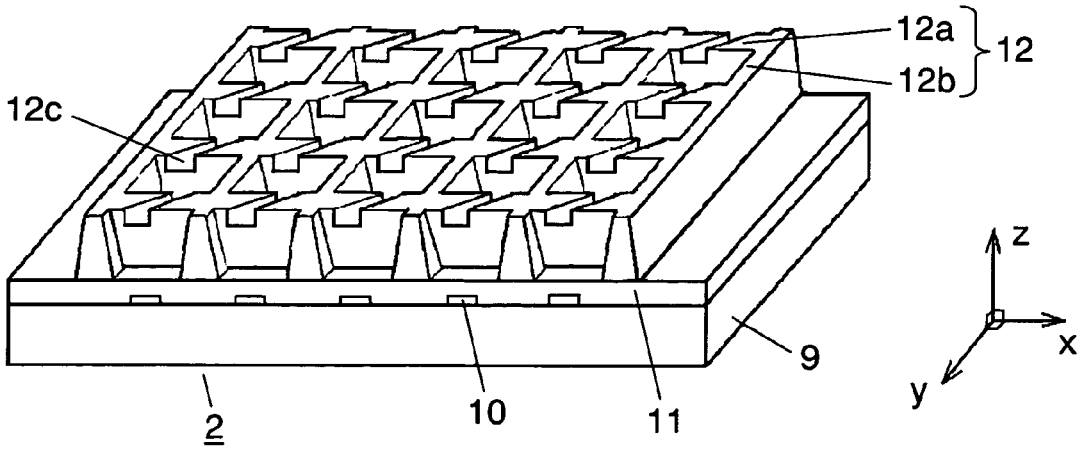
FIG. 8 is a perspective view showing a configuration of another rear panel of the PDP according to the first exemplary embodiment of the present invention.

Furthermore, in the above description, an example in which an opening height of communication portion 12*c*, that is, a depth of a groove as communication portion 12*c* is equal to the height of barrier rib 12 was described. However, the configuration is not particularly limited thereto. FIG. 8 is a perspective view showing a configuration of another rear panel according to the exemplary embodiment of the present invention. That is to say, as shown in FIG. 8, the opening height of communication portion 12*c* may be lower than the height of barrier rib 12. When the opening height of communication portion 12*c* is the same as the height of barrier rib 12, communication portions 12*c* can be formed at the same time barrier ribs 12 are formed, thereby making it possible to prevent the increase in the number of steps. On the other hand, when the opening height of communication portion 12*c* is lower than the height of barrier rib 12, the stability of the shape of the formed barrier ribs 12 can be improved.

Figure 9A:
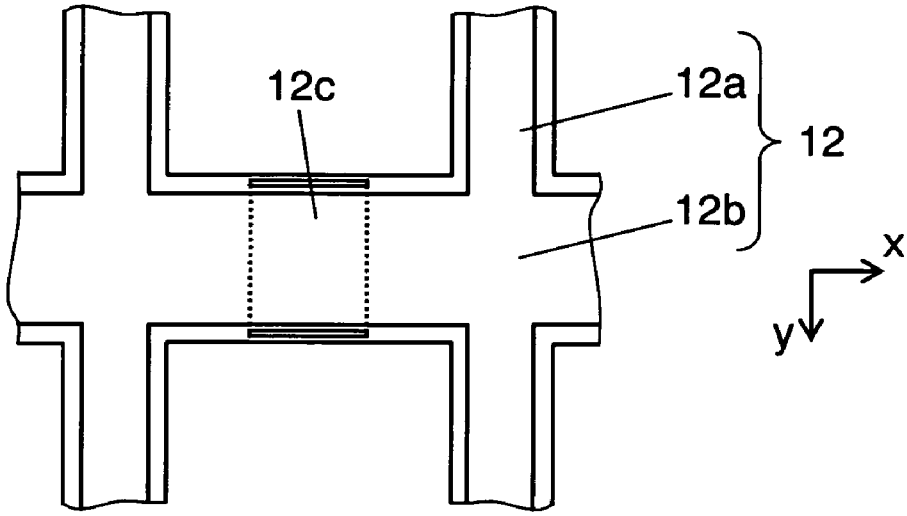
FIG. 9 is a view showing a configuration of another barrier rib of the PDP according to the first exemplary embodiment of the present invention.
Figure 9B:
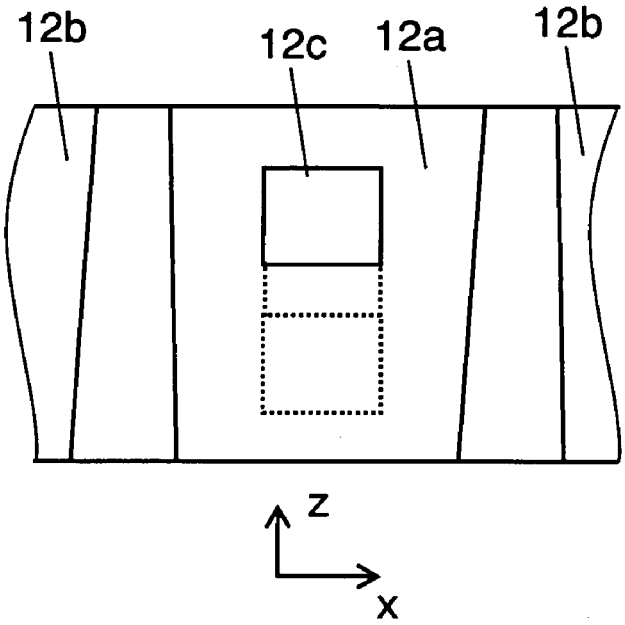
Figure 9C:
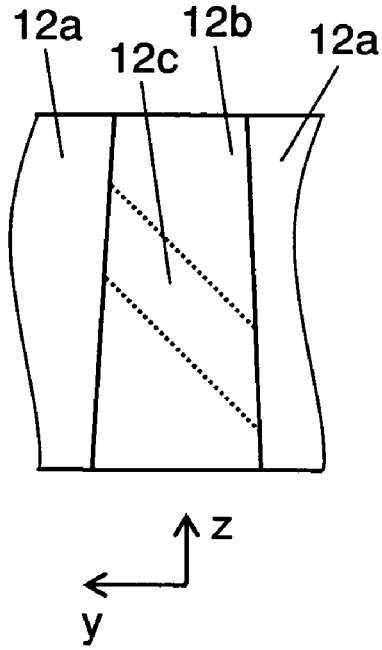

Furthermore, in the above description, an example in which communication portion 12*c* communicates in non-parallel to the column direction by disposing communication portion 12*c* obliquely toward the direction of x in the figures, however, the configuration is not particularly limited thereto. FIG. 9 is a view showing a configuration of another barrier rib of a PDP according to the exemplary embodiment of the present invention. FIG. 9A is a plan view thereof, FIG. 9B is a front view thereof; and FIG. 9C is a side view thereof, respectively. That is to say, as shown in FIG. 9, communication portion 12*c* may be formed obliquely with respect to the direction of z in row direction barrier rib 12*b* so as to communicate in non-parallel to the column direction. Furthermore, the opening of communication portion 12*c* may have any shapes.

Second Exemplary Embodiment

Figure 10:
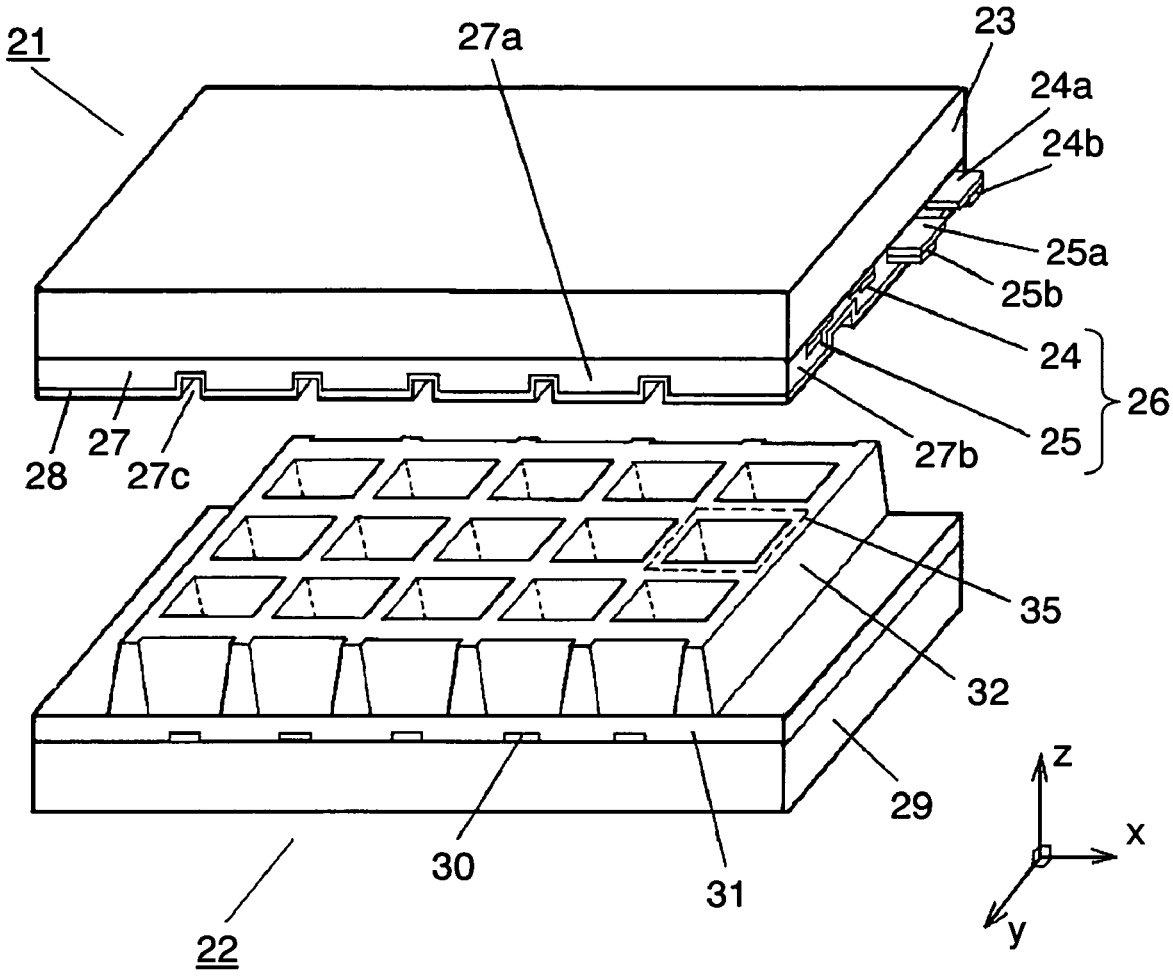
FIG. 10 is a perspective view showing a schematic configuration of the PDP according to a second exemplary embodiment of the present invention.

FIG. 10 is a perspective view showing a schematic configuration of a PDP according to a second exemplary embodiment of the present invention.

As shown in FIG. 10, the PDP according to the second exemplary embodiment includes front panel 21 and rear panel 22. Note here that in FIG. 10, for easy understanding of the structure, front panel 21 and rear panel 22 are drawn separately.

Plural pairs of stripe-shaped display electrodes 26 composed of scan electrode 24 and sustain electrode 25, extending in the row direction (in the direction of x in FIG. 10), are formed on transparent front substrate 23 such as a glass substrate made of sodium borosilicate glass made by the floating method. Dielectric layer 27 is formed so as to cover a group of display electrodes 26. Protective film 28 made of MgO is formed on dielectric layer 27. Thus, front panel 21 is configured. Note here that scan electrode 24 and sustain electrode 25 are respectively composed of transparent electrodes 24*a* and 25*a* and bus electrodes 24*b* and 25*b* which are made of Cr/Cu/Cr, Ag, or the like and electrically connected to transparent electrodes 24*a* and 25*a*. Furthermore, dielectric layer 27 is formed in a lattice including row direction protrusions 27*a* and column direction protrusions 27*b*, which are the same in height, in the row direction and in the column direction, respectively. Row direction protrusions 27*a* are provided with communication portions 27*c* having an opening height that is the same as a height of row direction protrusion 27*a*.

Furthermore, rear panel 22 includes address electrodes 30 in the direction extending in the column direction (in the direction of y in FIG. 10) and intersecting display electrodes 26 on rear substrate 29 disposed opposing front substrate 23. Dielectric layer 31 is formed so as to cover address electrode 30. On dielectric layer 31, barrier ribs 32 are formed in a lattice in which the height in the row direction is equal to the height in the column direction.

Then, on the side faces of a part between barrier ribs 32 and on the surface of dielectric layer 31, phosphor layers (not shown) are formed. For color displaying, the phosphor layers are usually arranged in the order of red, green and blue.

Front panel 21 and rear panel 22 are disposed opposing each other and sealed together at the peripheries with a sealing material with barrier ribs 32 interposed therebetween such that display electrode 26 and address electrode 30 intersect each other and small discharge space is formed inside. Discharge gas obtained by mixing xenon (Xe) and at least one of neon (Ne) and helium (He) is filled in the discharge space at a pressure of about 66500 Pa (500 Torr). Thus, the PDP is formed. Herein, from the viewpoint of efficiency, it is preferable that the partial pressure of Xe is 5% to 50%.

This discharge space of the PDP is divided into a plurality of partitions by the lattice form of barrier ribs 32 facing the lattice form of row direction protrusions 27*a* and column direction protrusions 27*b* of dielectric layer 27. Display electrodes 26 and address electrodes 30 are disposed intersecting each other so that the divided discharge space becomes discharge cell 35 that is a unit light-emitting region.

In this PDP, images are displayed by generating electric discharge by a periodic voltage applied to address electrode 30 and display electrode 26, and irradiating a phosphor layer with ultraviolet light generated by the electric discharge, so that the ultraviolet light is converted into visible light by the phosphor layer.

Figure 11:
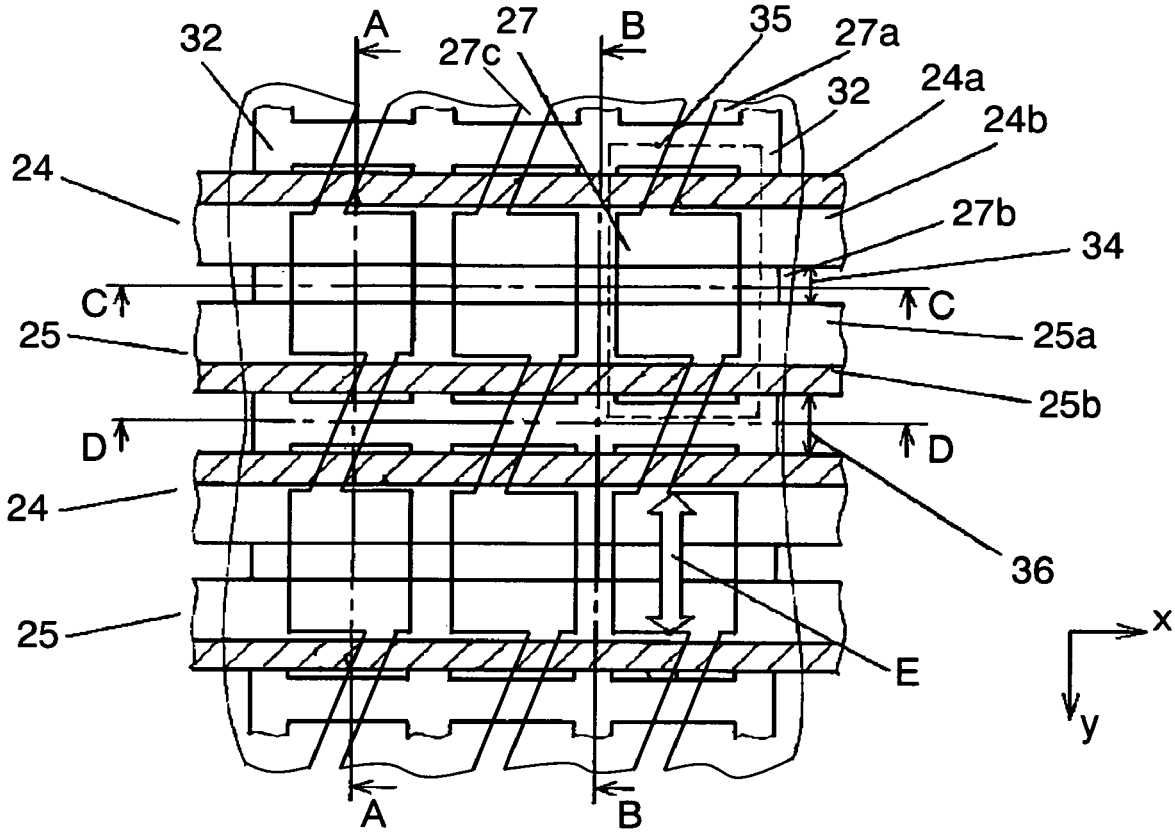
FIG. 11 is a plan view showing a schematic configuration of an image display part seen from the side of a front panel of the PDP.
Figure 12:
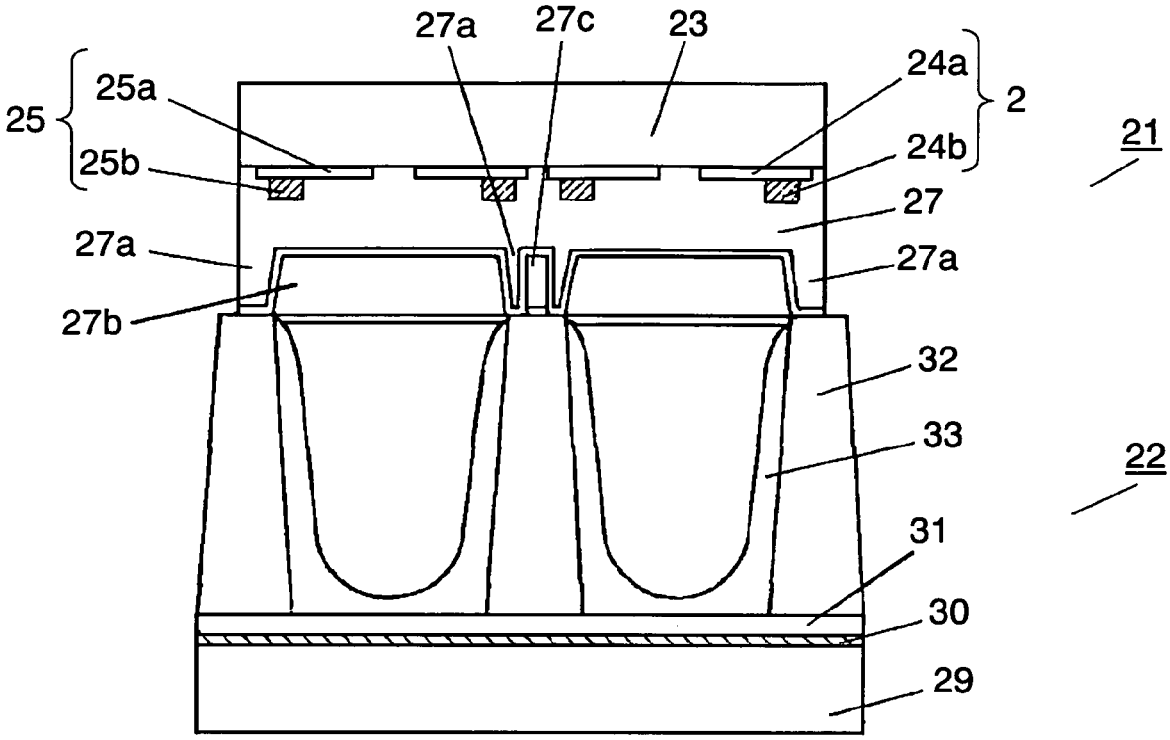
FIG. 12 is a sectional view of a part along line A-A of FIG. 11.
Figure 13:
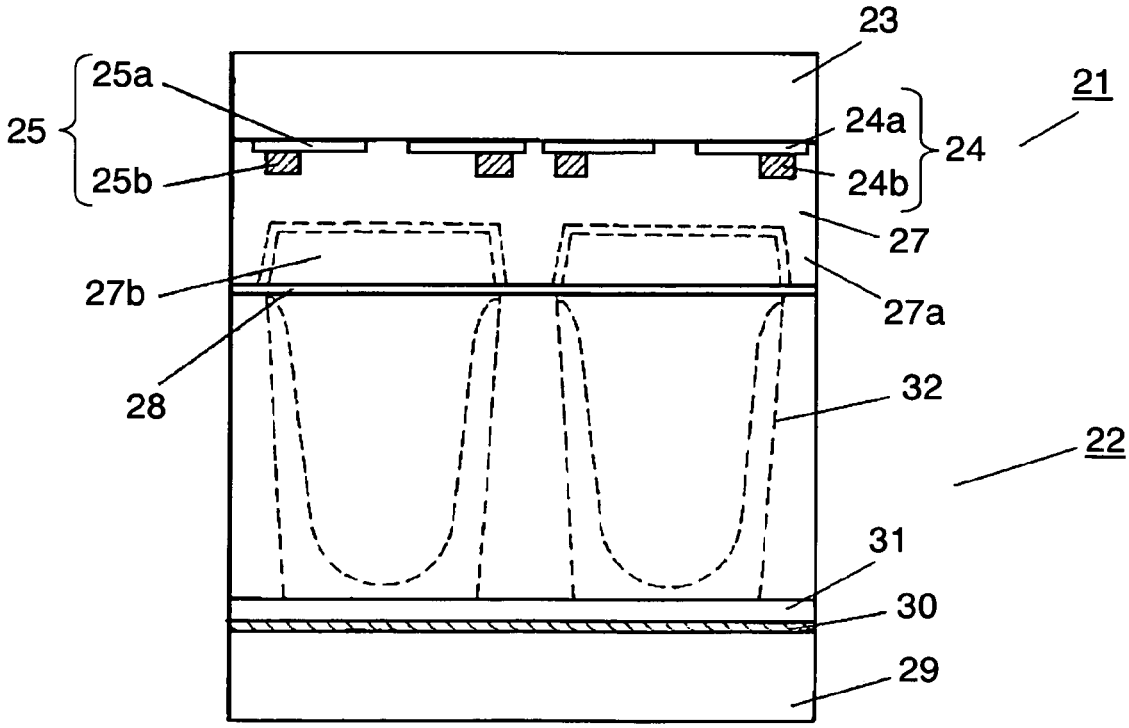
FIG. 13 is a sectional view of a part along line B-B of FIG. 11.
Figure 14:
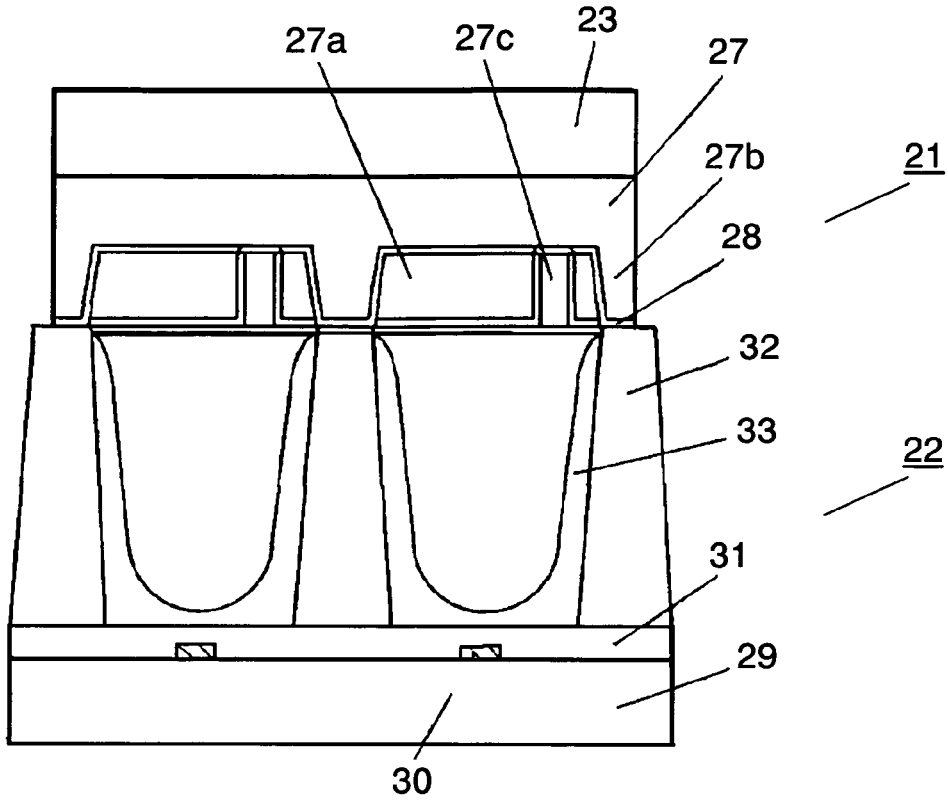
FIG. 14 is a sectional view of a part along line C-C of FIG. 11.
Figure 15:
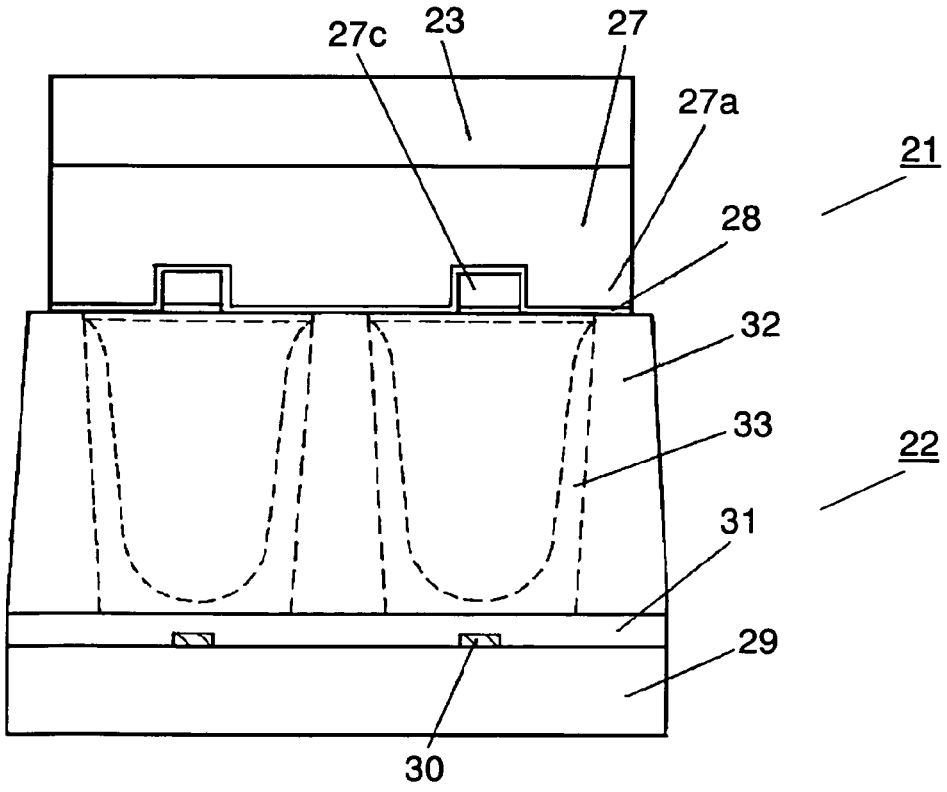
FIG. 15 is a sectional view of a part along line D-D of FIG. 11.

FIG. 11 is a plan view showing a schematic configuration of an image display part seen from the side of a front panel of the PDP according to the second exemplary embodiment of the present invention. Furthermore, sectional views of parts along lines A-A, B-B, C-C and D-D in FIG. 11 are shown in FIGS. 12, 13, 14 and 15, respectively. Furthermore, in these figures, also phosphor layer 33 is additionally shown.

As shown in FIGS. 11 to 15, scan electrode 24 and sustain electrode 25 are arranged alternately in the column direction such that they are neighboring each other with discharge gap 34 interposed therebetween in each line of a matrix display. Herein, a region surrounded by barrier ribs 32 and row direction protrusions 27*a* and column direction protrusions 27*b* becomes discharge cell 35 that is a unit light-emitting region. Furthermore, non-light emitting region 36 may be provided with black stripe (not shown) for the purpose of improving contrast.

In the PDP according to the second exemplary embodiment of the present invention mentioned above, barrier rib 32 and row direction protrusion 27*a* and column direction protrusion 27*b* of dielectric layer 27 are respectively formed in a lattice in which the height is equal both in the row direction and in the column direction, face each other, and form a plurality of individually divided discharge cells 35 in a part in which display electrode 26 and address electrode 30 intersect each other. The row direction protrusions 27*a* of the dielectric layer 27 have communication portions 27*c* communicating neighboring discharge cells 35 in non-parallel to the column direction.

Figure 16A:
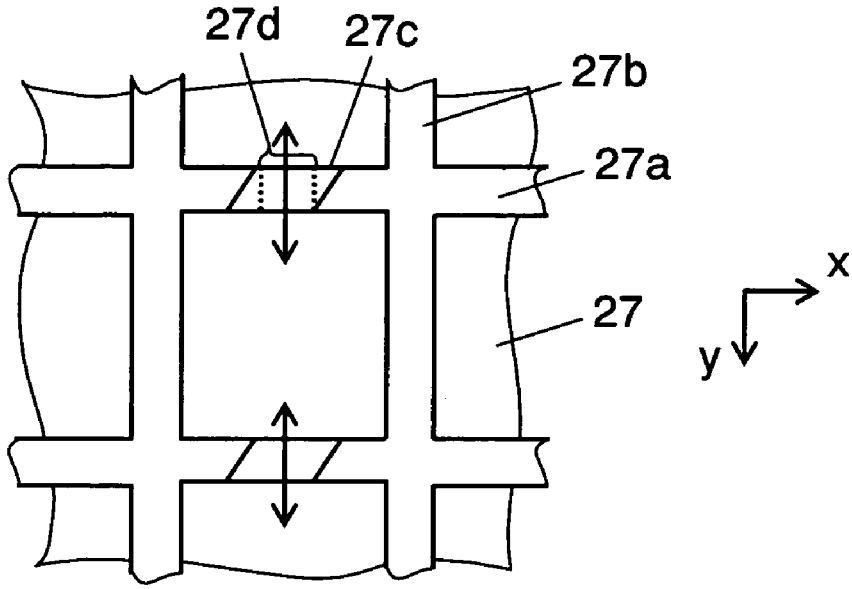
FIG. 16 is a plan view to illustrate a detail of a protrusion of a dielectric layer.
Figure 16B:
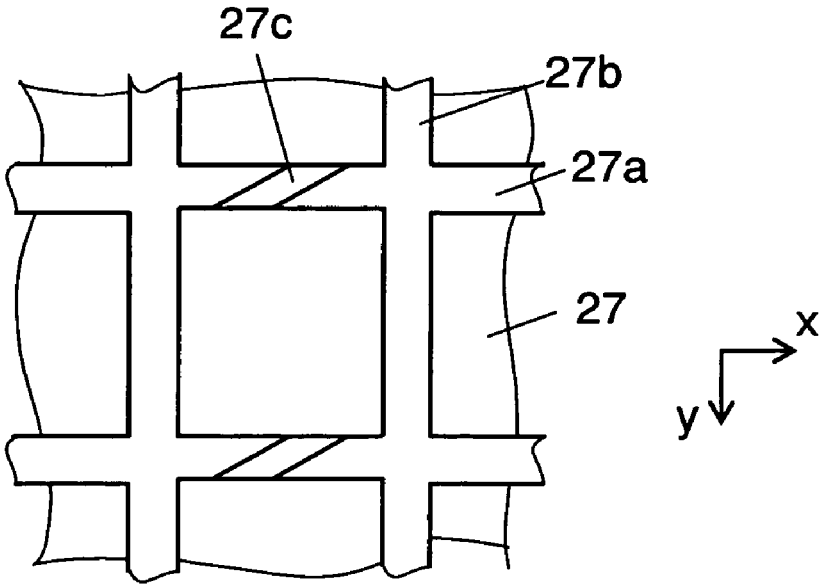
Figure 17:
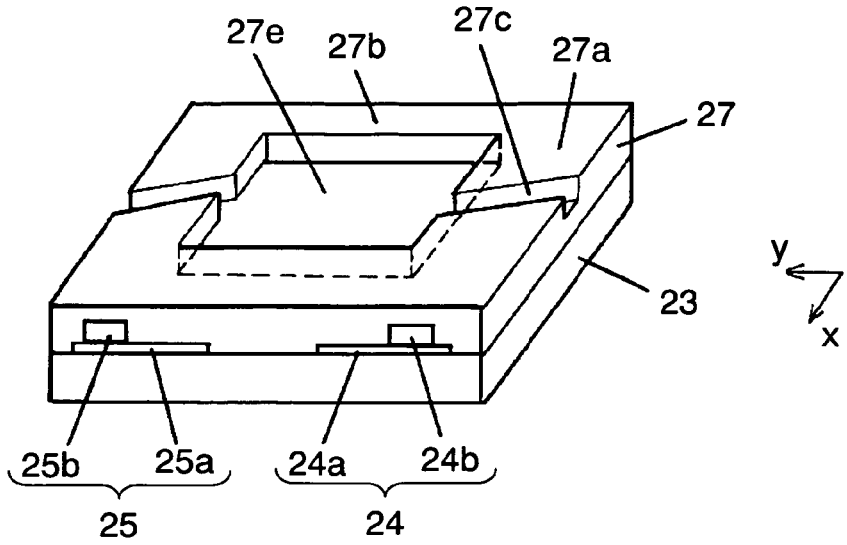
FIG. 17 is a perspective view showing a configuration when a concave portion formed in the dielectric layer is quadrangle in the PDP according to the second exemplary embodiment of the present invention.

Herein, "communicating in non-parallel to the column direction" means that communication portion 27*c* does not communicate between neighboring discharge cells 35 in parallel to the column direction. FIG. 16 is a plan view to illustrate a detail of dielectric layer 27 and row direction protrusions 27*a* and column direction protrusions 27*b* thereof. As shown in FIG. 16A, even when communication portion 27*c* is provided in non-parallel to the column direction (in the direction of y), in a case where communication portion 27*c* has region 27*d* communicating in parallel, it is not included in the category of the present invention. On the other hand, as shown in FIG. 16B, communication portion 27*c* in a state in which a region communicating in parallel does not exists is communication portion 27*c* "communicating in non-parallel to the column direction."

As mentioned above, by providing barrier ribs 32 and row direction protrusions 27*a* and column direction protrusions 27*b* of dielectric layer 27, in the PDP of this exemplary embodiment, discharge error between neighboring discharge cells 35 can be suppressed, and also impurity gas can be released from the inner part of the PDP and discharge gas can be filled into the inner part of the PDP, satisfactorily.

That is to say, according to this exemplary embodiment, barrier ribs 32 and row direction protrusion 27*a* and column direction protrusion 27*b* of dielectric layer 27 are formed in a lattice in which the height is equal both in the row direction and in the column direction, face each other, and are arranged so as to surround the peripheries of discharge cells 35. However, since row direction protrusions 27*a* are provided with communication portions 27*c*, impurity gas can be released from the inner part of the individual discharge cells and discharge gas can be filled into the inner part of the individual discharge cells, satisfactorily.

Furthermore, the reason why discharge error occurs is thought to because charged particles due to discharge reach neighboring discharge cells 35 so as to affect them. The charged particles have vectors of movement along potential distribution generated by a voltage applied between scan electrode 24 and sustain electrode 25. That is to say, as shown by an arrow E of FIG. 11, charged particles having a vector in parallel to the column direction are main charged particles. Therefore, even when row direction protrusions 27*a* are provided with communication portions 27*c*, since communication portions 27*c* are in non-parallel to the column direction, the probability of charged particles passing through communication portion 27*c* and reaching neighboring discharge cells 35 reduces, thus enabling the problem of discharge error to be suppressed.

Note here that in the above description, an example in which one communication portion 27*c* is provided in each row direction barrier rib 27*a*. However, a plurality of communication portions 27*c* may be provided.

Figure 18:
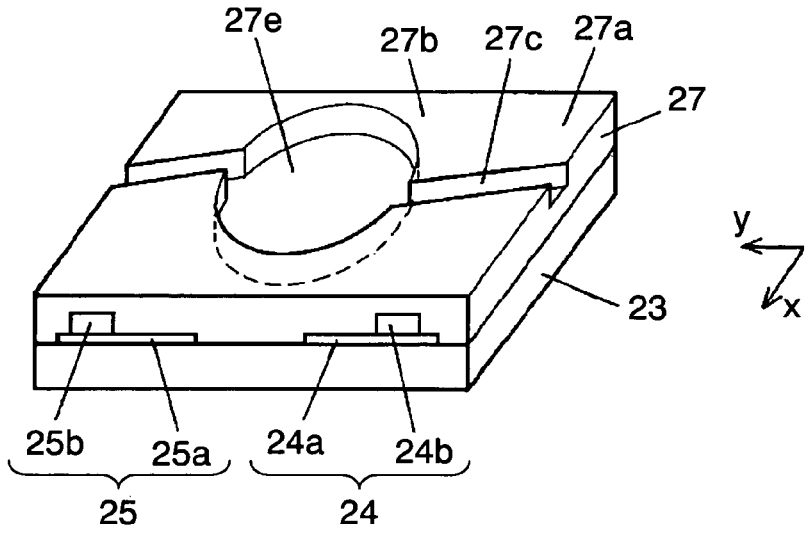
FIG. 18 is a perspective view showing a configuration when a concave portion formed in the dielectric layer is circle in the PDP.
Figure 19:
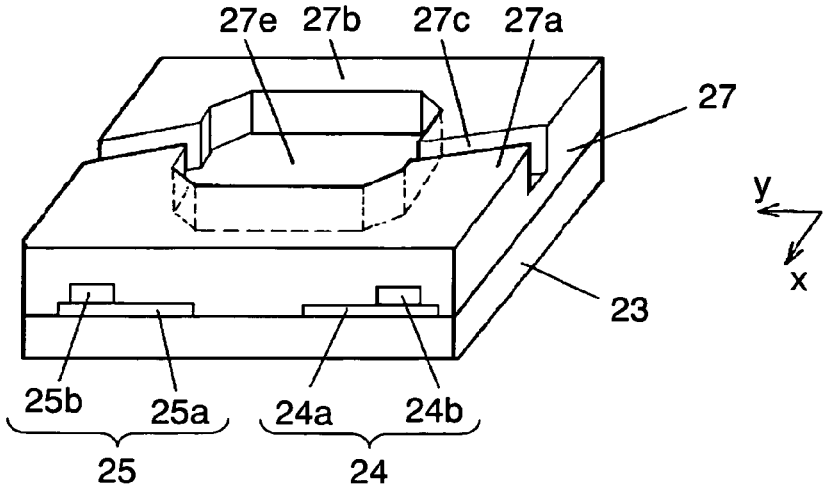
FIG. 19 is a perspective view showing a configuration when a concave portion formed in the dielectric layer is polygon in the PDP.
Figure 20:
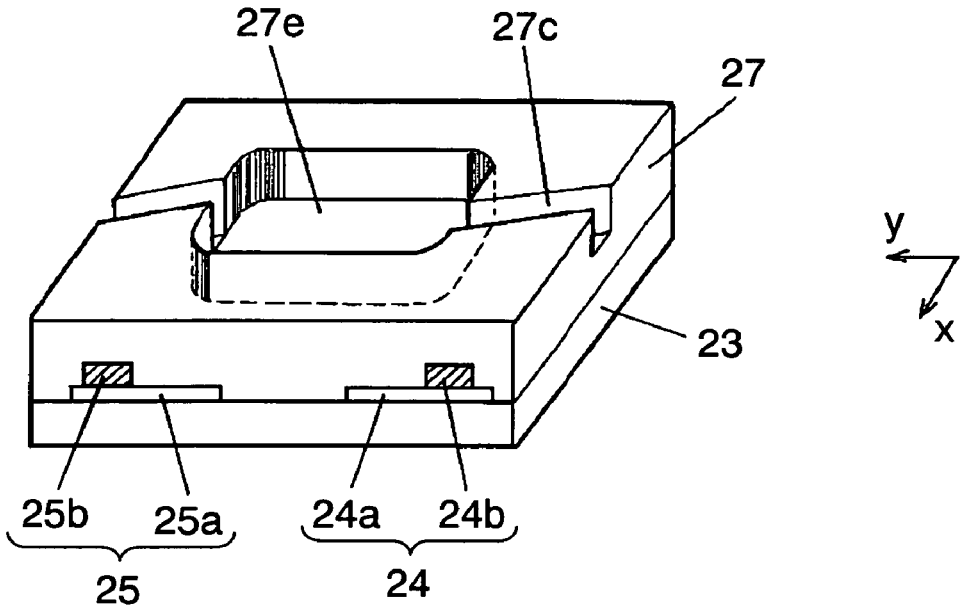
FIG. 20 is a perspective view showing a configuration when a concave portion formed in the dielectric layer is polygon whose corners are round chamfered in the PDP.

Furthermore, FIGS. 17 to 20 are perspective views showing shapes of concave portion 27*e* formed in dielectric layer 27 by being surrounded by protrusions provided in dielectric layer 27. The shape of concave portion 27*e* formed by being surrounded by row direction protrusions 27*a* and column direction protrusions 27*b* may include circle, ellipse, polygon or quadrangle with four corners chamfered (round chamfered in the drawing) as shown in FIGS. 18 to 20 in addition to quadrangle shown in FIG. 17. Herein, it is preferable that the shape of concave portion 27*e* is a shape whose corners are not sharpened as shown in FIGS. 18 to 20, because stress concentration acting on the corners of concave portion 27*e* can be relaxed, resulting in forming the shape of protrusions 27*a* and 27*b* stably. Note here that FIGS. 17 to 20 show the shapes of concave portion 27*e* in one discharge cell 35. In entire front panel 21, such concave portions 27*e* are arranged in a matrix, and dielectric layer 27 has a shape having lattice shaped protrusions.

Figure 21:
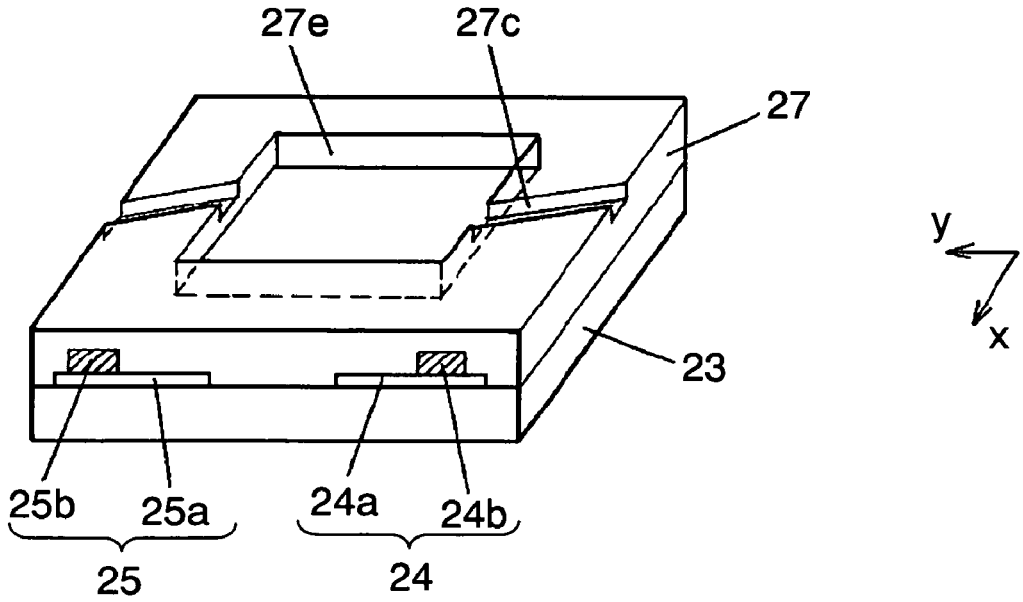
FIG. 21 is a perspective view showing a configuration in which an opening height of a communication portion is lower than the height of the protrusion in the PDP.
Figure 22:
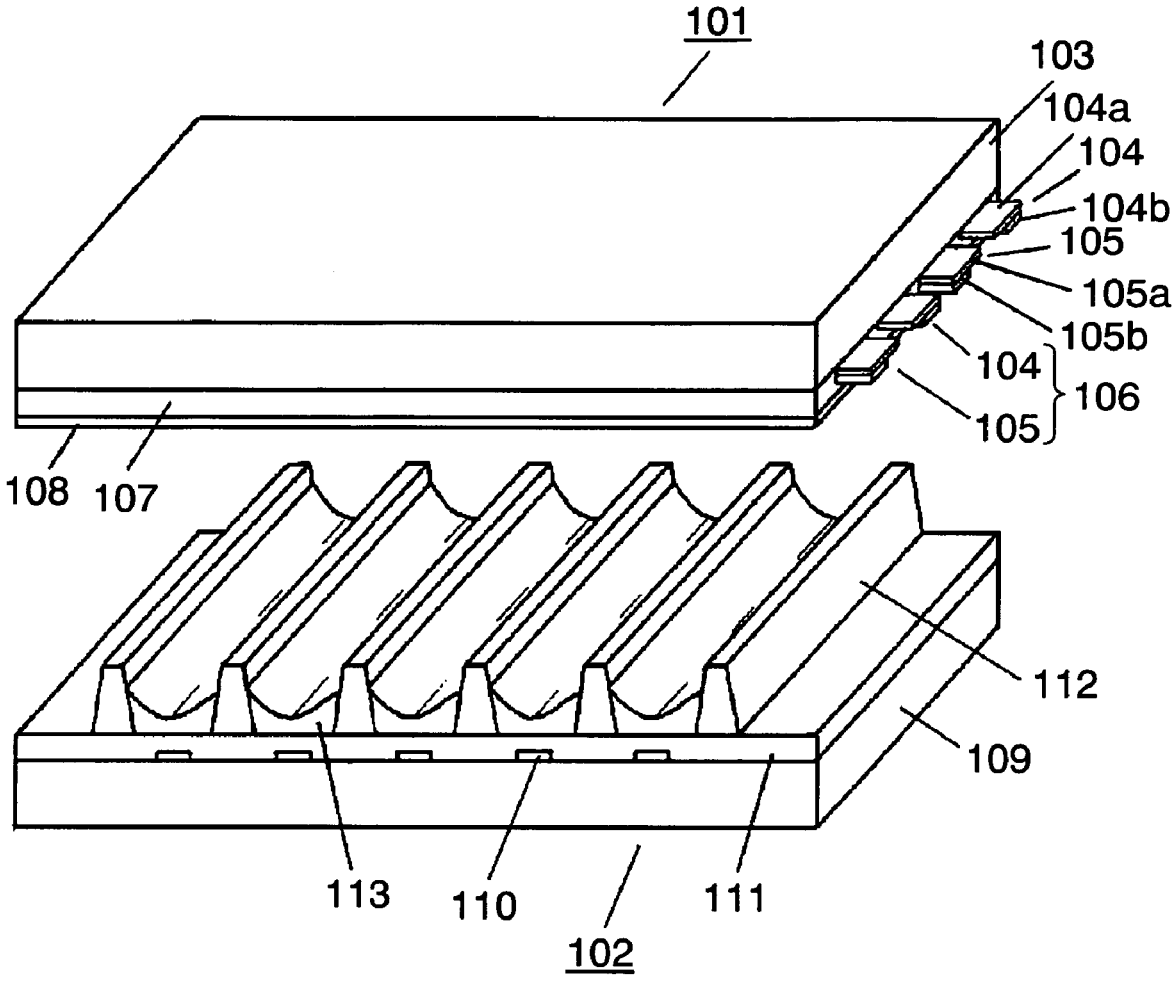
FIG. 22 is a perspective view showing a schematic configuration of a conventional PDP.
Figure 23:
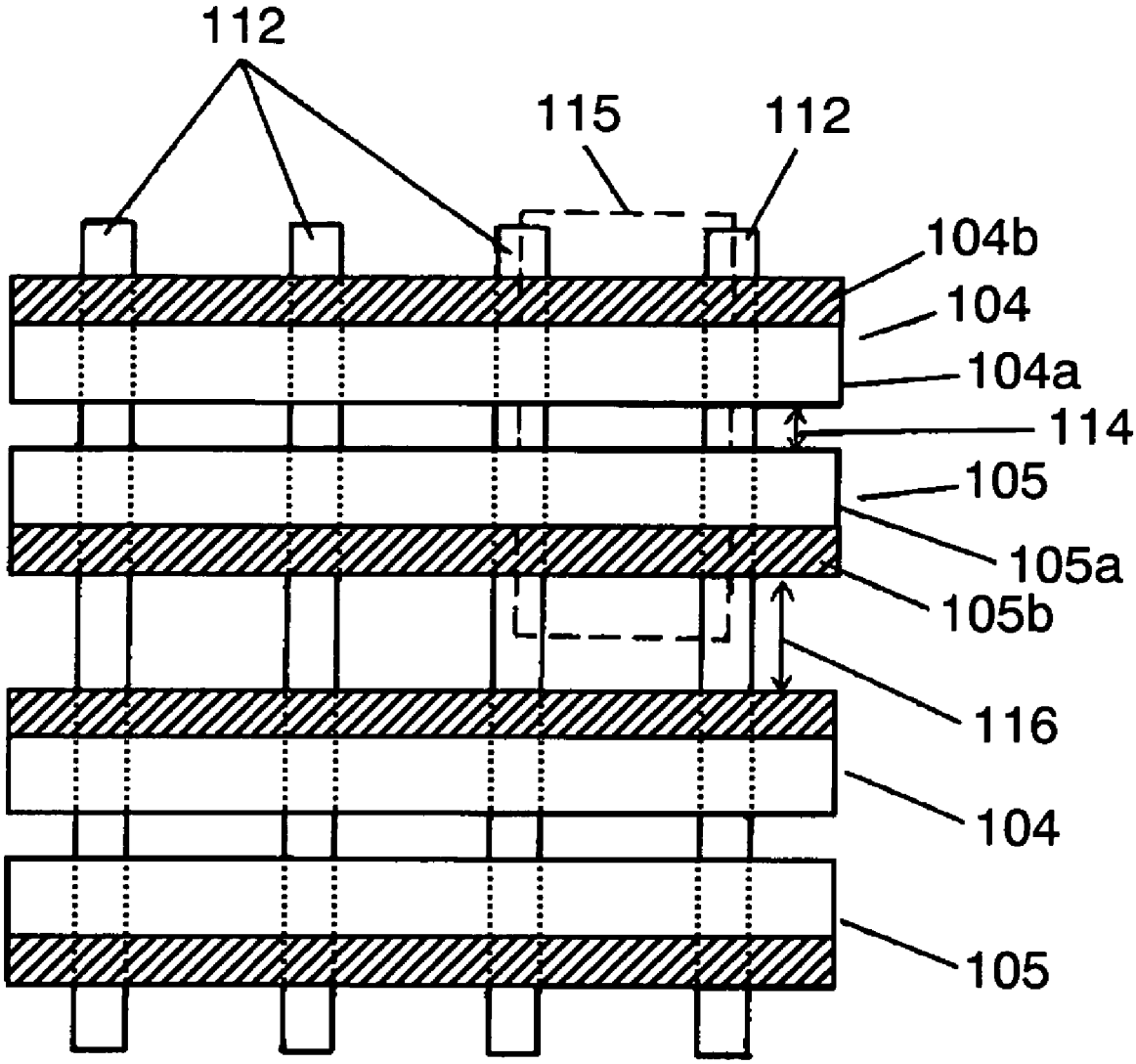
FIG. 23 is a plan view showing a schematic configuration of an image display part seen from the side of a front panel of a conventional PDP.

Furthermore, in the above description, an example in which an opening height of communication portion 27*c*, that is, the depth of a groove as communication portion 27*c* in this exemplary embodiment is the same as the height of the protrusion was described. However, the configuration is not particularly limited thereto. As shown in FIG. 21, the opening height of communication portion 27*c* may be lower than the heights of row direction protrusion 27*a* and column direction protrusion 27*b*. When the opening height of communication portion 27*c* is the same as the height of protrusion, communication portion 27*c* can be formed at the same time protrusion is formed, thereby making it possible to prevent the increase in the number of steps. On the other hand, when the opening height of communication portion 27*c* is lower than the height of protrusions, the stability of the shape of the formed protrusions can be improved.

Furthermore, in the above description, an example in which communication portion 27*c* is communicated in non-parallel by disposing communication portion 27*c* obliquely toward the direction of x in the figures was shown. However, the configuration is not particularly limited thereto and may be disposed obliquely, for example, in the direction of z so as to communicate in non-parallel to the column direction.

Furthermore, the opening of communication portion 27*c* may be any shapes.

Furthermore, row direction protrusion 27*a* and column direction protrusion 27*b* formed on dielectric layer 27 may be black like a black stripe, when they are formed in non-light emitting region 36 of each discharge cell 35. In this case, since row direction protrusion 27*a* and column direction protrusion 27*b* can be also used as a black stripe, the number of steps is not increased.

The total film thickness of dielectric layer 27 at the protrusion is preferably 5 μm to 60 μm for the total of the film thickness of a base part and the film thickness of the protrusion itself. For example, when the film thickness of the base part of dielectric layer 27 on discharge gap 34 is 30 μm and the film thickness of the protrusion itself is 20 μm, the total film thickness of the dielectric layer 27 is 50 μm.

INDUSTRIAL APPLICABILITY

As mentioned above, the present invention can realize a PDP capable of improving the brightness and image quality by satisfactorily suppressing discharge error, releasing impurity gas and filling discharge gas.

The invention claimed is:

1. A plasma display panel comprising:

a front panel and a rear panel disposed opposing each other, the front panel comprising a display electrode composed of a scan electrode and a sustain electrode extending in a row direction, and the rear panel comprising an address electrode extending in a column direction and intersecting the display electrode, wherein a plurality of individually divided discharge cells are formed in a part in which the display electrode and the address electrode intersect each other, and discharge cells neighboring in the column direction of the discharge cells communicate to each other by a communication portion communicating the discharge cells in a non-parallel to the column direction, wherein the communication portion is provided obliquely with respect to the column direction.

2. The plasma display panel according to claim 1, wherein a mixed gas of Xe and at least one selected from Ne and He is filled in an inner space of the discharge cell, and a partial pressure of Xe is in the range from 5% to 50%.

3. A plasma display panel comprising:

a front panel and a rear panel disposed opposing each other, the front panel comprising a display electrode composed of a scan electrode and a sustain electrode extending in a row direction, and the rear panel comprising an address electrode extending in a column direction and intersecting the display electrode, wherein the rear panel comprises a lattice form of barrier ribs of row direction barrier ribs and column direction barrier ribs, which are equal in height, forming a plurality of individually divided discharge cells, in a part in which the display electrode and the address electrode intersect each other; and the row direction barrier ribs of the barrier ribs are provided with communication portions communicating the neighboring barrier ribs in non-parallel to the column direction.

4. The plasma display panel according to claim 3, wherein an opening height of the communication portion is the same as the height of the barrier rib.

5. The plasma display panel according to claim 4, wherein a mixed gas of Xe and at least one selected from Ne and He is filled in an inner space of the discharge cell, and a partial pressure of Xe is in the range from 5% to 50%.

6. The plasma display panel according to claim 3, wherein the opening height of the communication portion is lower than the height of the barrier rib.

7. The plasma display panel according to claim 6, wherein a mixed gas of Xe and at least one selected from Ne and He is filled in an inner space of the discharge cell, and a partial pressure of Xe is in the range from 5% to 50%.

8. The plasma display panel according to claim 3, wherein the communication portion is provided obliquely with respect to the column direction.

9. The plasma display panel according to claim 8, wherein a mixed gas of Xe and at least one selected from Ne and He is filled in an inner space of the discharge cell, and a partial pressure of Xe is in the range from 5% to 50%.

10. The plasma display panel according to claim 3, wherein a mixed gas of Xe and at least one selected from Ne and He is filled in an inner space of the discharge cell, and a partial pressure of Xe is in the range from 5% to 50%.

11. A plasma display panel comprising: a front panel and a rear panel disposed opposing each other, the front panel comprising a display electrode composed of a scan electrode and a sustain electrode extending in a row direction, and a dielectric layer covering the display electrode, and the rear panel comprising an address electrode extending in a column direction and intersecting the display electrode;

wherein the rear panel comprises a lattice form of barrier ribs of row direction barrier ribs and column direction barrier ribs, which are equal in height, forming a plurality of individually divided discharge cells, in a part in which the display electrode and the address electrode intersect each other; the dielectric layer has a lattice form of protrusions of row direction protrusions and column direction protrusions, which are equal in height, facing the lattice form of barrier ribs; and the row direction protrusions are provided with communication portions communicating the neighboring discharge cells in non-parallel to the column direction.

12. The plasma display panel according to claim 11, wherein the opening height of the communication portion is the same as the height of the protrusion.

13. The plasma display panel according to claim 12, wherein a mixed gas of Xe and at least one selected from Ne and He is filled in an inner space of the discharge cell, and a partial pressure of Xe is in the range from 5% to 50%.

14. The plasma display panel according to claim 11, wherein the opening height of the communication portion is lower than the height of the protrusion.

15. The plasma display panel according to claim 14, wherein a mixed gas of Xe and at least one selected from Ne and He is filled in an inner space of the discharge cell, and a partial pressure of Xe is in the range from 5% to 50%.

16. The plasma display panel according to claim 11, wherein a shape of a concave portion formed by being surrounded by the lattice form of protrusions is one shape selected from circle, ellipse and polygon.

17. The plasma display panel according to claim 16, wherein a mixed gas of Xe and at least one selected from Ne and He is filled in an inner space of the discharge cell, and a partial pressure of Xe is in the range from 5% to 50%.

18. The plasma display panel according to claim 11, wherein the communication portion is provided obliquely with respect to the column direction.

19. The plasma display panel according to claim 18, wherein a mixed gas of Xe and at least one selected from Ne and He is filled in an inner space of the discharge cell, and a partial pressure of Xe is in the range from 5% to 50%.

20. The plasma display panel according to claim 11, wherein a mixed gas of Xe and at least one selected from Ne and He is filled in an inner space of the discharge cell, and a partial pressure of Xe is in the range from 5% to 50%.

* * * * *